US006210248B1

(12) United States Patent
McAdam

(10) Patent No.: US 6,210,248 B1
(45) Date of Patent: Apr. 3, 2001

(54) BOOK USEABLE WITH A GAME PIECE, SUCH AS A BOOK WITH AN INTERNAL PASSAGEWAY

(75) Inventor: Christine McAdam, Bellevue, WA (US)

(73) Assignee: Indigo Corporation, Bellevue, WA (US)

( * ) Notice: Subject to any disclaimer, the term of this patent is extended or adjusted under 35 U.S.C. 154(b) by 0 days.

(21) Appl. No.: 09/372,545

(22) Filed: Aug. 11, 1999

(51) Int. Cl.[7] ..... A63H 33/38

(52) U.S. Cl. ..... 446/147; 446/170; 446/475; 281/38; 281/51

(58) Field of Search ..... 446/71, 170, 147, 446/148, 149, 150, 151, 152, 475; 281/38, 51; 283/49; 434/178

(56) References Cited

U.S. PATENT DOCUMENTS

| | | | | |
|---|---|---|---|---|
| 1,014,759 | * | 1/1912 | Kovacs | 446/149 |
| 3,256,634 | * | 6/1966 | Mace | 446/151 |
| 3,918,180 | * | 11/1975 | Chamberlin . | |
| 5,031,935 | | 7/1991 | D'Andrea | 281/15.1 |
| 5,238,345 | | 8/1993 | D'Andrea | 412/4 |
| 5,363,984 | * | 11/1994 | Laird, III . | |
| 5,478,120 | | 12/1995 | D'Andrea | 283/117 |
| 5,573,438 | | 11/1996 | D'Andrea | 446/149 |
| 5,681,199 | | 10/1997 | Morris | 446/73 |
| 5,967,874 | * | 10/1999 | Shaw et al. | 446/147 |

FOREIGN PATENT DOCUMENTS

| | | | | |
|---|---|---|---|---|
| 2131591 | * | 6/1984 | (GB) | 446/147 |

* cited by examiner

*Primary Examiner*—Jacob K. Ackun
*Assistant Examiner*—Jeffrey D. Carlson
(74) *Attorney, Agent, or Firm*—Perkins Coie LLP

(57) ABSTRACT

A game such as a book useable with candy or other game pieces. The book includes internal passageways configured to allow a game piece to travel freely therein. One aspect of the invention includes a book with multiple pages including internal passageways in one or more pages, and wherein an outlet form one page substantially aligns with an inlet from an adjacent page such that the game piece moves between pages. Under another aspect of the invention, the page includes an actuator such as a lever or a wheel to move the game piece between portions of the passageway. In yet another aspect of the invention, the book includes an integral game piece dispenser.

20 Claims, 9 Drawing Sheets

BOOK USEABLE WITH A GAME PIECE, SUCH AS A BOOK WITH AN INTERNAL PASSAGEWAY

TECHNICAL FIELD

The invention relates generally to a book, and more particularly to an interactive book that uses one or more game pieces.

BACKGROUND OF THE INVENTION

Children's books and games have traditionally been available on not only a variety of topics, but also in a variety of shapes, sizes and styles. Children's books are often designed to induce children to read, as well as to keep the child's interest throughout the book. For example, children's books have been designed with, among other things, bright illustrations, scratch and sniff areas, pop-up figures, and lift-up flaps. Many of these features in the books are designed to teach children new skills, such as dexterity, memory, or imagination and reasoning.

Developing children continuously learn new cognitive and physical skills. Books have been recognized as helping children with letter and word recognition, as well as improving their small motor skills. The more interactive the user was with the book, on both a cognitive level as well as being able to physically manipulate portions of the book, the greater opportunity there was for the user to learn on a variety of levels.

SUMMARY OF THE INVENTION

The present invention improves upon the prior art and provides additional benefits. Under one aspect of the invention, a book is usable with a game piece such as candy or the like. The book includes a front cover, a back cover, and a plurality of pages, wherein one of the pages has an internal passageway for the game piece. The internal passageway includes an inlet and an outlet. The inlet is shaped and sized to receive the game piece. The outlet is spaced apart from the inlet and sized to allow the game piece to exit the passageway. Under another aspect of the invention, multiple pages of the book contain internal passageways, wherein an outlet from a first page is substantially aligned with an inlet from an adjacent page such that the game piece is allowed to travel through the internal passageways and adjacent pages. Under another aspect of the invention, an actuator, such as a rotatable wheel or a pullable tab, interconnects discontinuous portions of the passageway and moves the game piece between a first portion of the passageway and a second portion of the passageway. Under still another aspect of the invention, a game piece dispenser is attached to the book. In one embodiment, the game piece dispenser has an opening aligned with an inlet aperture of an internal passageway such that game pieces are selectively dispensed into the internal passageway of the page. Under another aspect of the invention, a game piece container is mounted to the book to retain game pieces when not in use.

DETAILED DESCRIPTION OF THE INVENTION

Figure 1:
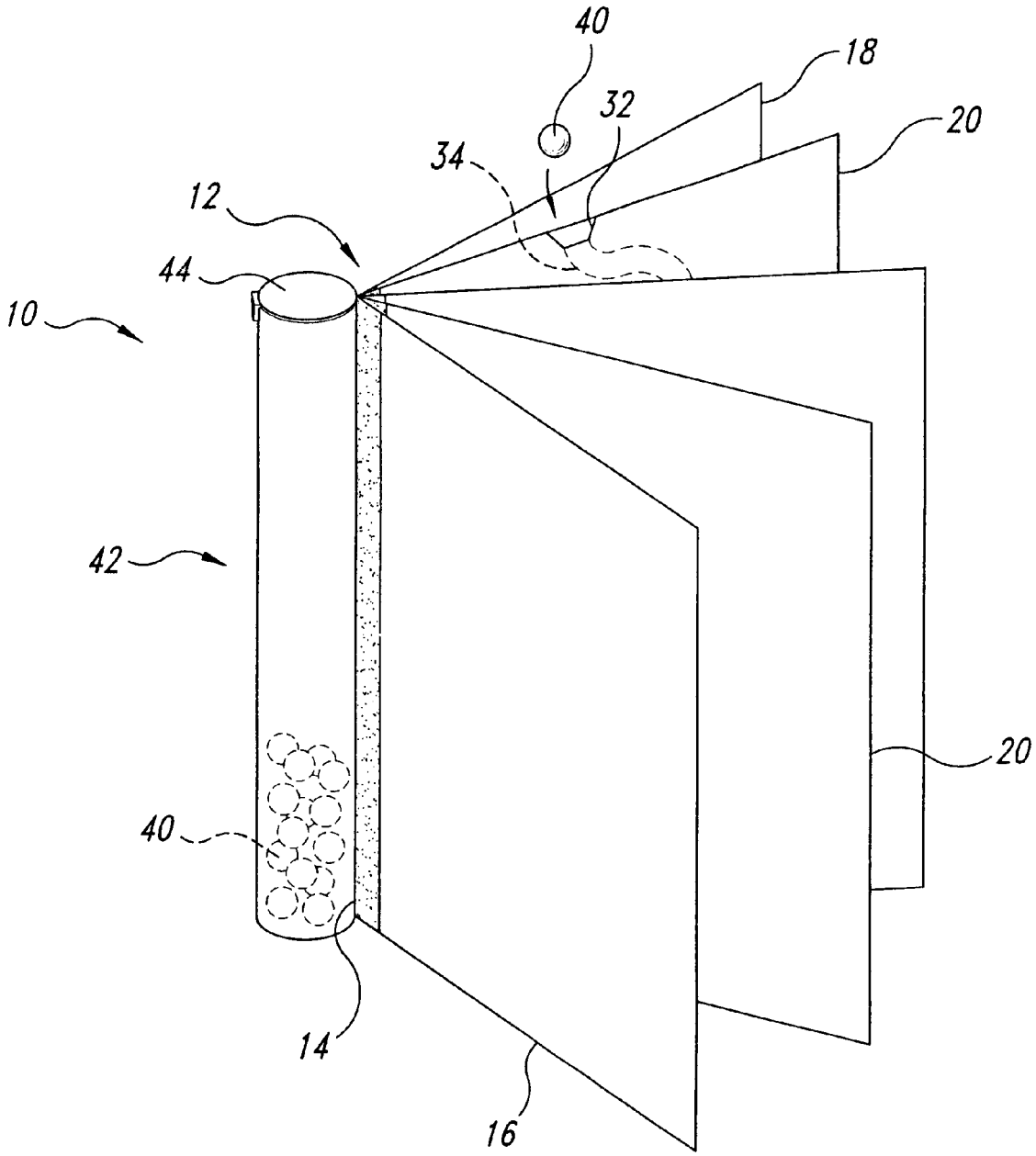
FIG. 1 is a schematic isometric view of a book in accordance with an embodiment of the present invention, the book having a plurality of pages connected together at a spine, and a candy or game piece container is mounted to the book's spine.

A book 10 in accordance with embodiments of the invention is shown in the drawings for purposes of illustration. The book 10 is usable with a piece of candy 40 that becomes a game piece in an interactive game played by a user, such as a child or the like. The book 10 has a plurality of pages 20 and at least one page with an internal passageway 34. During game play a child or other user places the candy in the passageway 34, and depending upon the game or book configuration, the candy may come out of the passage at selected or random positions or locations on the page.

As best seen in FIG. 1, the book 10 in accordance with one embodiment includes a front cover 16 and a back cover 18 with the plurality of pages 20 therebetween. At least one of the pages 20 has the internal passageway 34 therein, although a passageway could also be in the front cover 16, back cover 18, or both. The passageway 34 defines a travel path through the page for candy 40. The front cover 16, back cover 18, and plurality of pages 20 are bound together along one edge 14 with a binding 12. The binding 12 may be accomplished by a variety of devices, including, but not limited to, adhesive, staples, clips, rings, or plastic clasps.

In the illustrated embodiment, the book 10 also has a candy container 42 securely connected to the binding 12, and is shaped and sized to contain multiple pieces of candy 40 or other game pieces. The candy container 42 includes a lid 44 that can be securely closed so that the candy 40 does not spill out of the container 42 when the candy 40 is being stored. In alternate embodiments, the candy container 42 may be removably attached to the book. The container 42 may also be removably or fixedly mounted to the front or back cover and may be refillable. In an alternate embodiment, the container 42 contains or is refilled with game pieces.

The candy 40 may be any shape, such as, but not limited to, a spherical piece, an elliptical piece, a triangular piece, or a cubical piece. In alternative embodiments, the game piece is a three-dimensional character taken from the theme of the book 10.

Figure 2:
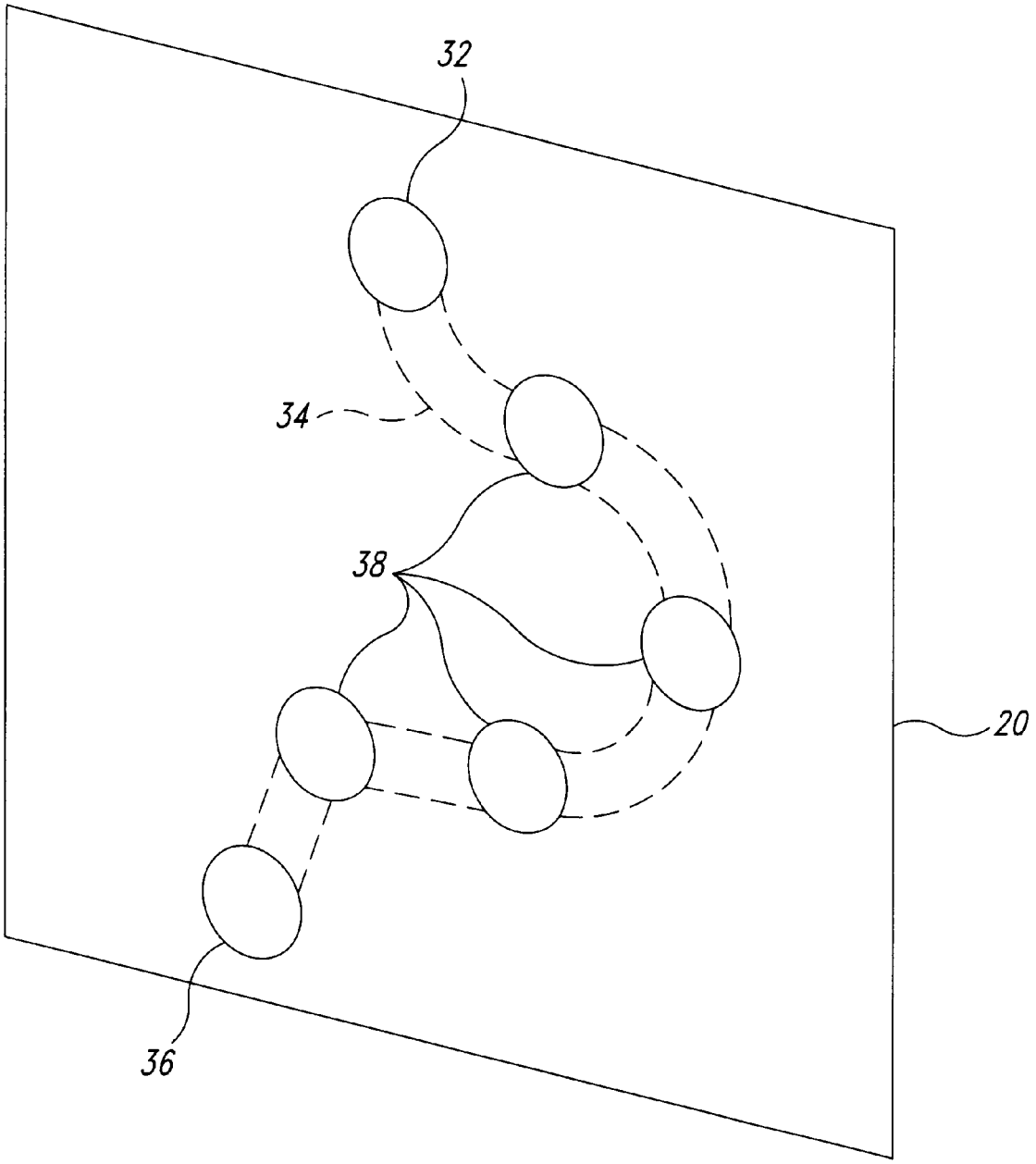
FIG. 2 is a plan view of one page of the book shown in FIG. 1, the page includes an internal passageway with an inlet aperture and multiple outlet apertures.

The internal passageway 34 contained within the front cover 16, back cover 18, or pages 20 may include any number of configurations including, but not limited to, smooth walled tunnels, cylindrical tubes, or angled pathways. As illustrated in FIG. 2, the passageway 34 in the pages 20 extends between an inlet aperture 32 and an outlet aperture 36. The internal passageway 34, the inlet aperture 32, and the outlet aperture 36, are all configured to allow the candy 40 or other game pieces to travel therethrough. The illustrated internal passageway 34 includes intermediate outlet apertures 38 along the route of the internal passageway 34. The intermediate outlet apertures 38, as well as the final outlet aperture 36, are configured to allow the candy 40 to exit from the passageway 34.

In the embodiment of FIGS. 1 and 2, the passageways 34 are within the pages 20 and substantially hidden from view. Accordingly, the user, such as a child, can see the inlet aperture 32 and the outlet apertures 36, but cannot see the travel path of the candy 40 through the passageway 34. So, the candy 40 "disappears" after it is put into the inlet aperture 32 and until it appears at one of the outlet apertures 36. In one embodiment, the internal passageway 34 is constructed so the candy 40 may appear at a random one of the outlet apertures 36, and the user may, during game play, guess where the candy 40 will appear.

In other embodiments, the passageways 34 may be partially or entirely visible from one or several pages of the book 10. Thus, although the pages 20 may not contain internal passageways 34, these pages 20 may contain overlapping see-through windows (not shown) which allow the user to view portions of the internal passageway 34 such that the progress of the candy 40 through the internal passageway 34 can be monitored as a story unfolds. Thus, the pages 20 without internal passageways and the pages 20 with internal passageways 34 are positioned adjacent to each other such that the candy 40 may be visible or manipulatable throughout the story.

In one embodiment, the front cover 16, back cover 18, and pages 20 that include an internal passageway 34 are constructed with a laminated assembly. The composite assembly includes outer layers sandwiching a core layer therebetween. Channels are formed in the core layer to define the passageways. The channels are configured to allow a piece of candy or game piece to travel through them. When the outer layers are laminated to both a top and bottom sides of the channeled core layer, the composite assembly provides internal passageways within the page or book cover. In an alternate embodiment, at least one of the outer layers is a removable cover. The cover may be removed to provide access to the channel, for example, to dislodge or remove a piece of candy or game piece from the internal passageway. Opaque card stock or other similarly stiff material can be used for the outer layers to form a semi-rigid page with hidden passageways. Alternatively, translucent materials can be used for all or a portion of the outer layer to allow the user to track the progress of the candy in the passageway. In an alternate embodiment, flexible materials can be used to form the page or book cover. Additionally, the core layer can be made out of paper stock, foam, wood, plastic, cardboard, or other material.

The pages 20 of the book 10 include text and illustrations that tell the story while encouraging the user and game participant to play along with the candy or game piece. The pages 20 are positioned adjacent to each other between the front and back cover of the book 10 such that the candy 40 is an integral part of the book's story. The inlet and outlet apertures 32 and 36 may form part of the illustration of the book, such as the mouth of an animal or the entry to a tunnel. The text of the book 10 may direct the user to tilt the book or rotate the book in a certain way before proceeding with the story, thus moving the candy 40 through the passageway 34 toward one of the outlets. In an alternate embodiment, the passageway 34 is accessible to move or dislodge the candy 40 or game piece with, for example, a finger, a tool or a similar devise. Additional apertures can be provided to allow the tool access into the passageway 34 to dislodge the candy 40 or gamepiece. Alternatively, the passageway 34 may be directly accessed by removing the removable cover. As the user follows the instructions and moves through the story, he or she is moving the candy 40 until it is released through the outlet aperture 36 as a reward for completing the story and successfully following the instructions.

The movable candy 40 or other game piece provides additional opportunities for the user to learn and participate in the reading ofthe book 10 as well as to practice his or her coordination and physical dexterity skills. In young users who are not yet able to decipher the written word, the tactile manipulation of the game piece through the story also serves to retain their interest and promote cognitive cause and effect thinking skills.

In the illustrated embodiment of FIGS. 1 and 2, the pages 20 are substantially square. In alternate embodiments, the pages 20 are configured in different shapes, such as other geometric shapes, or shapes configured to resemble selected items or characters. Each page 20 of the book 10 may be identical to the adjacent page or may have a unique shape. Adding shape to a page to form, for example, the outline of an animal or toy, reinforces the theme of the book, and will provide additional visual stimulation to the user.

Figure 3:
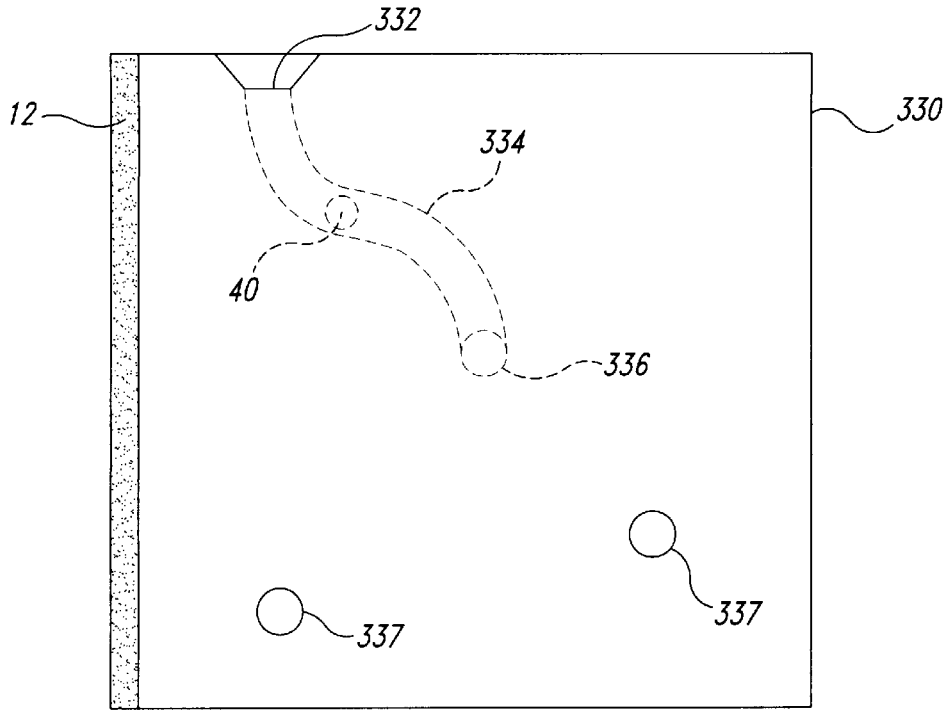
FIG. 3 is a plan view of a book page in accordance with an embodiment of the present invention, the page includes an internal passageway having an inlet and an outlet aperture, the outlet aperture of this page aligns with the inlet aperture of a subsequent adjacent page.
Figure 4:
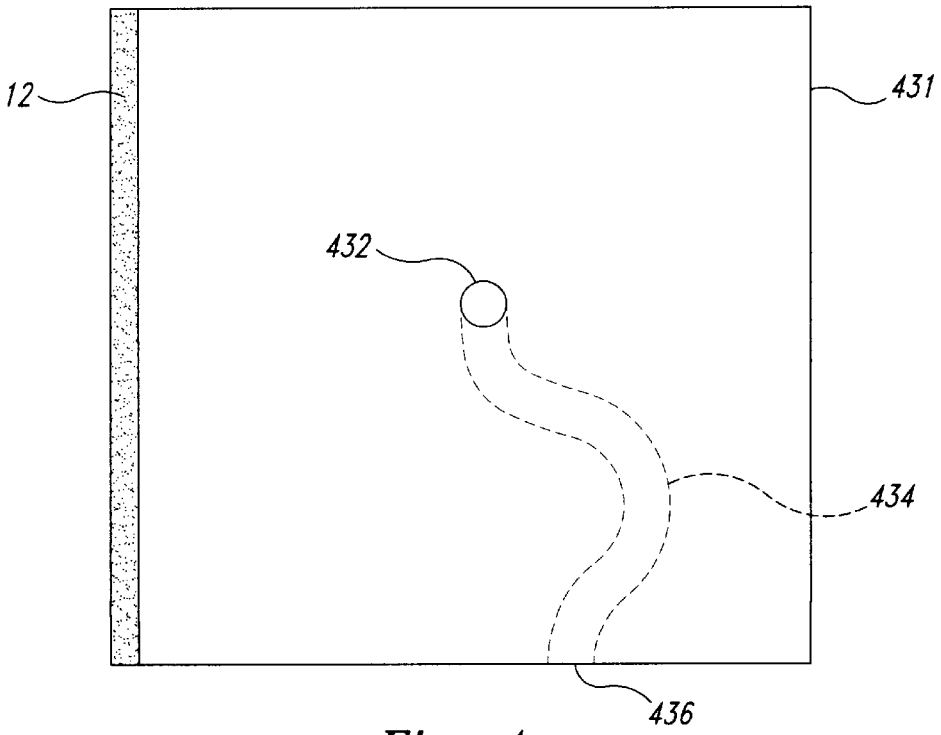
FIG. 4 is a plan view of an adjacent page to the page in FIG. 3, wherein the outlet aperture of the page in FIG. 3 aligns with an inlet aperture of this page shown in FIG. 4.

In another embodiment, shown in FIGS. 3 and 4, the book 10 includes multiple pages 330, 431 with internal passageways 334, 434 that communicate with each other so the candy 40 or other game piece can move through the passageways and between pages during game play. Each passageway 334, 434 includes an inlet aperture 332, 432 and at least one outlet aperture 336, 436 sized to allow the candy to pass into and out of the passageway. The passageways 334, 434 in adjacent pages are configured so the outlet aperture 336 of the one page 330 (FIG. 3) is aligned with the inlet aperture 432 of the adjacent page 431. Placing the pages adjacent to each other allows the candy 40 to travel from the inlet aperture 332 of the one page 330, through the internal passageway 334, and out the outlet aperture 336 into the inlet aperture 432 of the second page 431. The user turns the page 330 and continues moving the candy 40 through the book 10.

As illustrated in FIG. 4, the candy 40 then travels through the internal passageway 434 of the second adjacent page 431 and out the outlet aperture 436 of the second page 431. The candy 40 can pass into the passageway in an adjacent page or may be presented to the user as a reward for successfully completing all or portions or the game play. In alternate embodiments, additional pages with internal passageways can be adjacent to the pages 330 and 431 and can include outlet apertures aligned with inlet apertures such that the game piece can travel from adjacent page to adjacent page through a series of internal passageways within the book 10. Each page can contain a related but unique passageway configuration to provide an array of learning opportunities while keeping the child's interest. Alternatively, each page may contain a similar passageway configuration for the child to manipulate to provide repetitive practice of a skill.

As illustrated in FIG. 3, alternate embodiments to further challenge the child include blind holes 337 that are not connected to the internal passageway 334 of the page 330. The blind holes 337 in FIG. 3 are dead ends, so they make it more difficult to guess the travel path of the hidden passageway 334. These blind holes 337 challenge the child by providing an illusion of a false inlet, outlet or passageway. The blind holes 337 can also form part of a page illustration or the storyline in the book 10.

Figure 5:
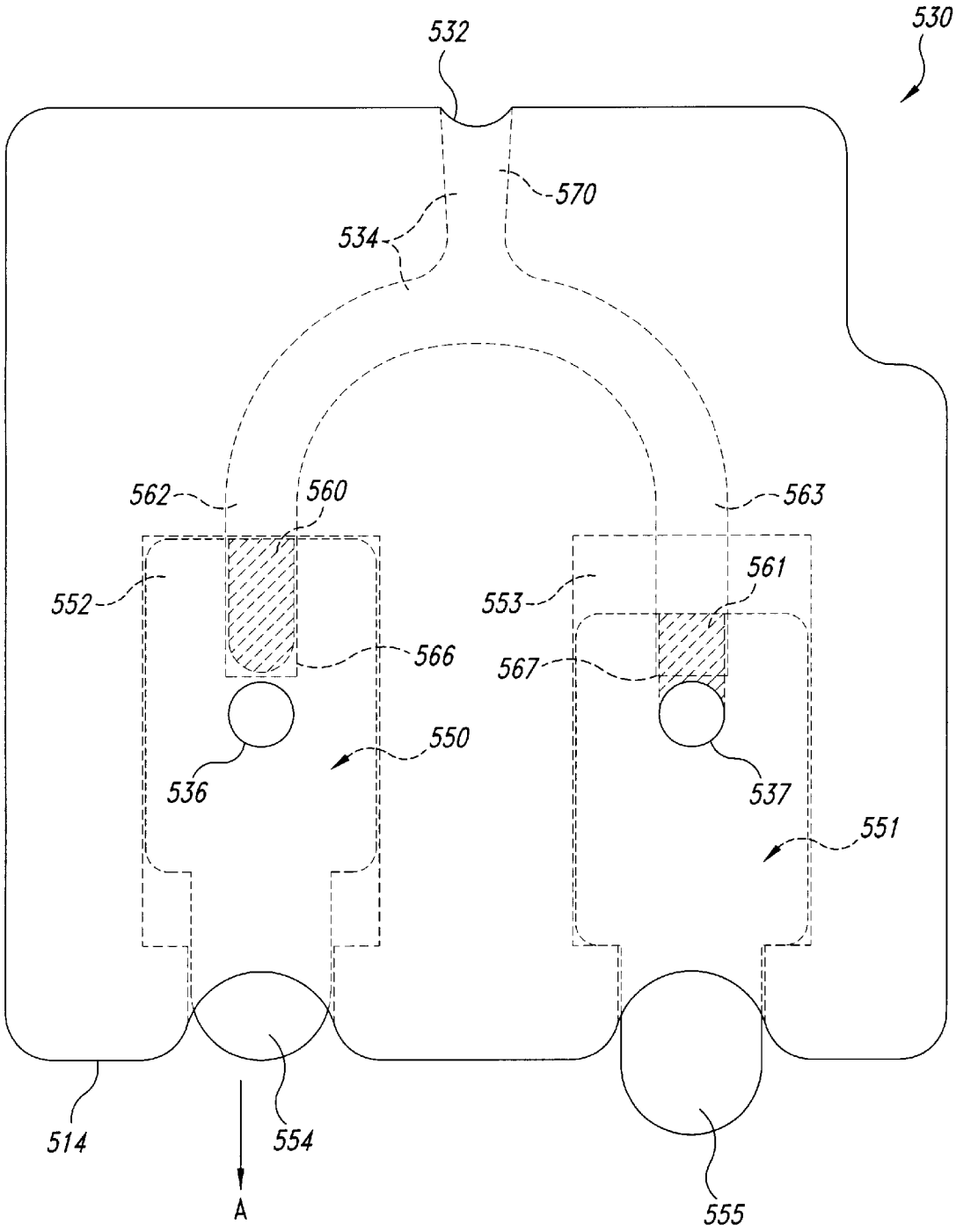
FIG. 5 is a plan view of one page of a book in accordance with an alternate embodiment, the page includes an internal passageway extending between an inlet aperture and two outlet apertures, and two pullable tabs with slots in communication with the passageway.

In another embodiment, shown in FIG. 5, the book includes one or more pages 530 with internal passageways 534 extending between an inlet aperture 532 and outlet apertures 536, 537 (shown in hidden lines). The illustrated passageway 534 is generally a wishbone shape, and the candy 40 moves from the inlet aperture 532 through an inlet passageway 570 into either a left portion 562 or a right portion 563 of the passageway.

As shown in FIG. 5, a first pullable tab 550 and a second pullable tab 551 act as actuators to control the travel of the candy 40 within the passageway's left and right portions 562, 563 relative to the outlet apertures 536, 537. The pullable tabs 550, 551 slide between a retaining position, shown by tab 550, in the direction of arrow A into a release position, shown by tab 551. The pullable tabs 550, 551 include an upper portion 552, 553 that includes retaining slots 560, 561. The first retaining slot 560 of the first pullable tab 550 aligns with the bottom 566 of the passageway's left portion 562 when the first pullable tab 550 is in the retained position. The second retaining slot 561 of the second pullable tab 551 aligns with the bottom 567 of the passageway's right portion 563 when the second pullable tab is in the retained position. Accordingly, the candy 40 can move through the internal passageway 534 and be temporarily captured in the retaining slots 560, 561.

The pullable tabs 550, 551 have a lower portion 554, 555 that is externally visable and accessible to be grabbed by a user. Pulling the lower portion 554, 555 causes the pullable tabs 550, 551 to slide downwardly. When the pullable tabs 550, 551 are moved into the release position, the candy 40 is aligned with the outlet apertures 536, 537, and released to the user.

In operation, such as during game play, the candy 40 enters through the inlet aperture 532, drops through the inlet passageway 570, and then passes into either the passageway's left portion 562 or the right portion 563. When the candy 40 reaches the bottom 566, 567 of the left or right portions 562, 563, the candy moves into the retaining slot in either the first or second pullable tabs 550, 551. In the illustrated embodiment, the internal passageway 534 is within the page 530 and not visible to the user, so the user can not see if the candy 40 is in the passageway's left or right portion 562, 563. Thus, the user must guess where the candy 40 is, and pull the selected pullable tab 550, 551 to try to release the candy through one of the outlet apertures 536, 537. By pulling the pullable tab 550 from the retaining position into the releasing position, the first retaining slot 560 moves from a position substantially aligned with the left passageway 562 into a position substantially aligned with the first outlet aperture 536. If the candy is in the left passageway 562, it will be released through the first outlet aperture 536 when the pullable tab 550 is pulled into the releasing position. Similarly, pulling the second pullable tab 551 will release the candy 40 if it is temporarily captured in the right passageway 563.

Figure 6:
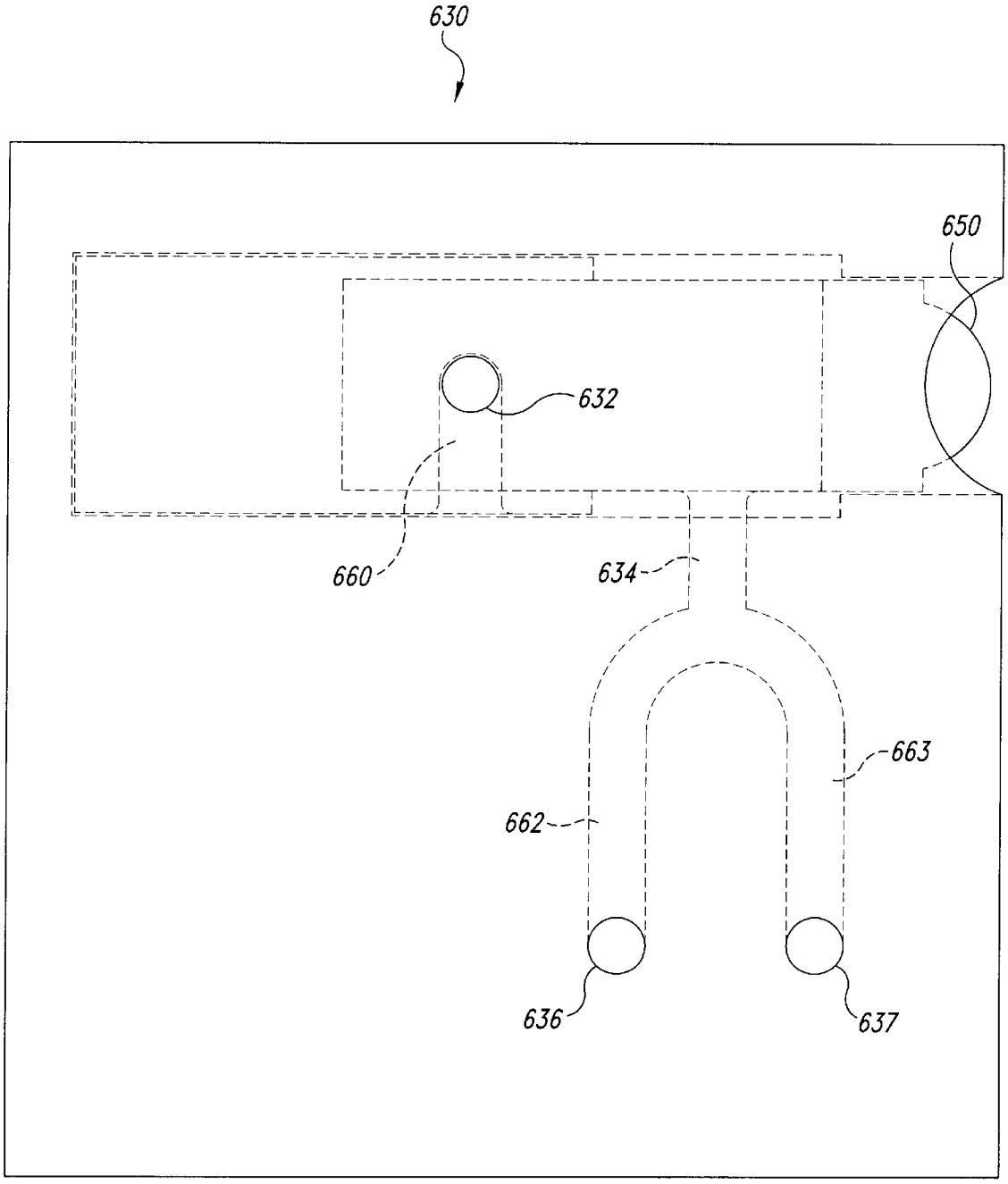
FIG. 6 is a plan view of a page of a book in accordance with an alternate embodiment, the page includes an actuator lever with a slot in communication with the internal passageway in the page.

In another embodiment shown in FIG. 6, the book 10 includes one or more pages 630 with an internal passageway 634 extending from an inlet aperture 632, through a slidable lever 650, to outlet apertures 636, 637 (shown in hidden lines). The passageway 634 is generally a wishbone shape such that the candy moves from a slot 660 in the slidable lever 650 to an upper portion of the passageway 634, into either a left or a right portion of the passageway 662, 663, and out of a corresponding outlet aperture 636, 637.

As shown in FIG. 6, the slidable lever 650 acts as an actuator to control the travel of the candy 40 between discontinuous portions of the passageway 634. The slidable lever is movable between a retaining position, and a releasing position. When the slidable lever 650 is moved into the releasing position, the slot 660 is substantially aligned with an upper portion of the passageway 634 above the left and right portions 662, 663. Thus, the candy 40 can move from the lever's slot 660 into the passageway's upper portion. The candy 40 then enters into either the passageway's left or right portion 662 or 663, and drops out through one of the outlet apertures 636, 637.

Figure 7:
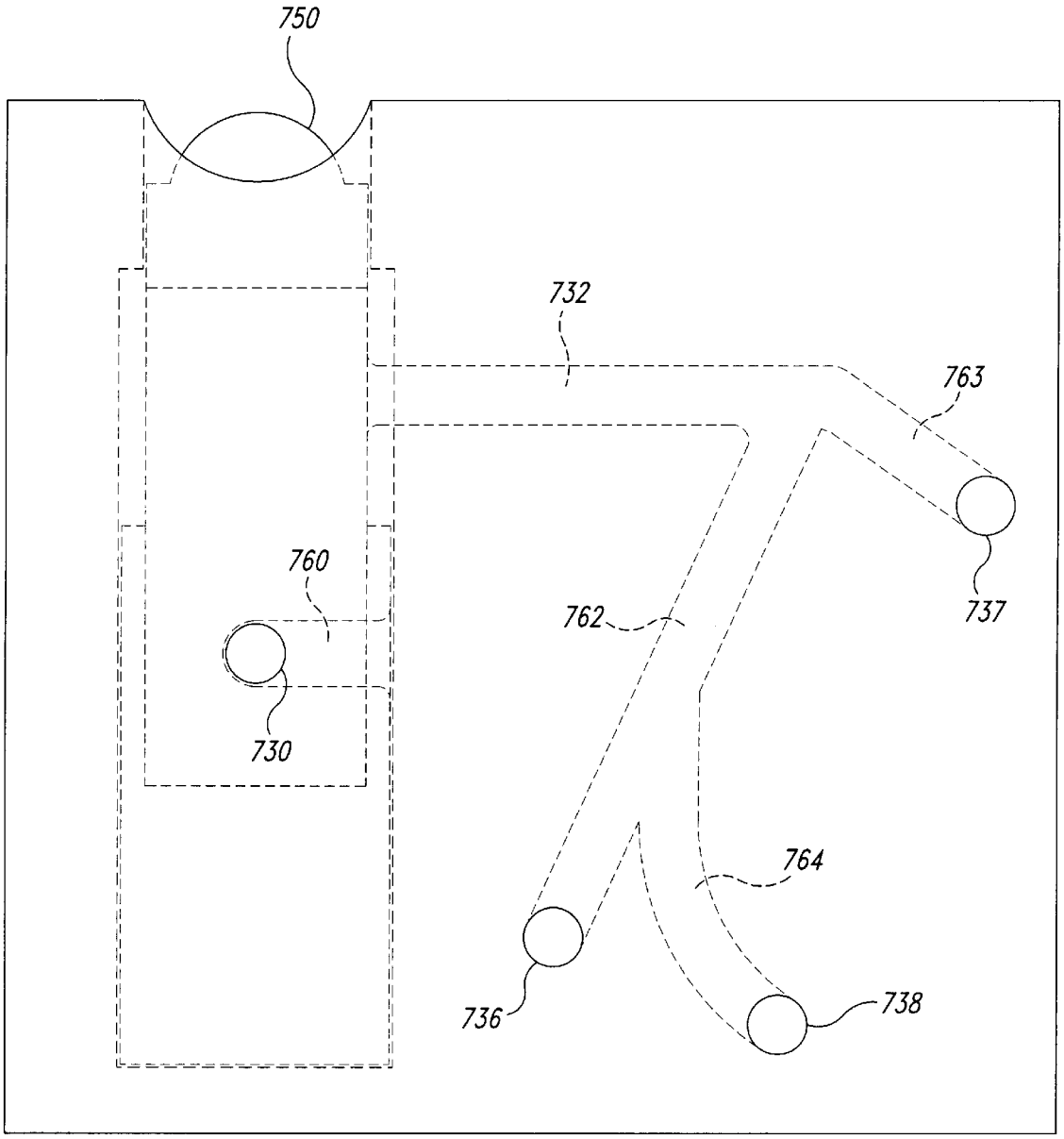
FIG. 7 is a plan view of a page of a book in accordance with another alternate embodiment, the page includes an actuator with a slot in communication with the internal passageway in the page.

As is shown in both FIGS. 6 and 7, these illustrative embodiments contain multiple travel passageways with corresponding outlet apertures. In FIG. 7, a pullable tab 750 contains an inlet aperture 730 in communication with a slot 760 shaped and sized to receive the candy 40 therein. When the candy 40 is inserted into the inlet aperture 732 and temporarily captured in the slot 760, the candy can be moved into substantial alignment with the main passageway 732 by pulling the tab 750 from a retaining position to a releasing position. Once the candy enters the main passageway 732, depending on the manipulation of the book by the child, the candy can travel down one of several branch passageways 762, 763, 764 to reach any one of the multiple outlets 736, 737, 738. It is recognized that many different configurations for the internal passageways exist, and these drawings illustrate but a few.

The embodiments illustrated in FIGS. 6 and 7 show the page with one lever. In other embodiments, additional levers can be used at different positions along the internal passageway so as to control movement of the candy through the passageway and between discontinuous portions of the passageway. Accordingly, a more complex maze-like configuration can be provided to make the process of getting the candy out of the passageway more challenging or require greater cognitive skills from the user.

Figure 8:
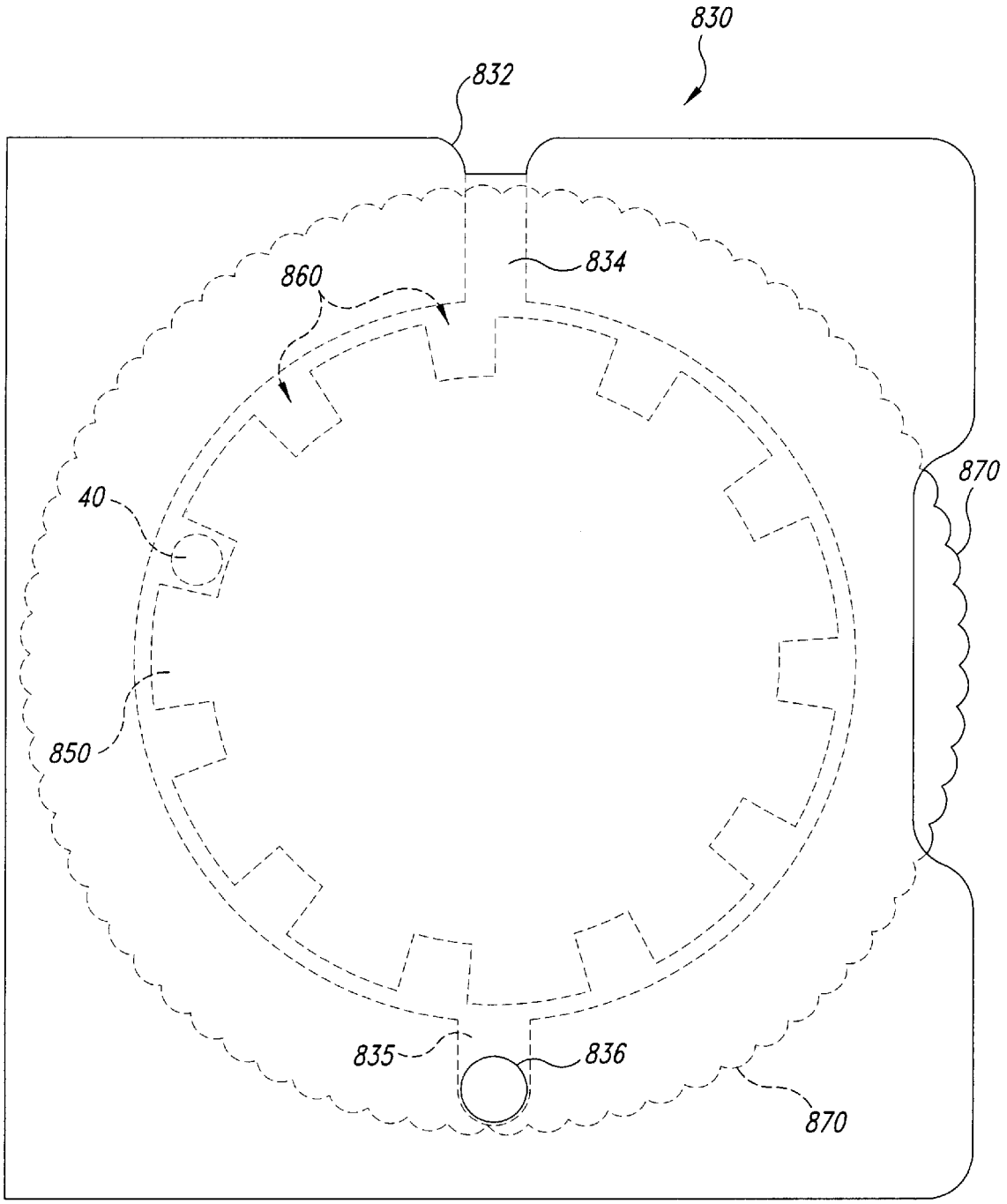
FIG. 8 is a plan view of a page of a book in accordance with another alternate embodiment, the page includes an internal passageway extending between an inlet and an outlet aperture and an internal actuator wheel, shown in hidden lines in the passageway.

In another embodiment shown in FIG. 8, an internal wheel 850 acts as an actuator to manipulate the candy 40 through the passageway 834 within a page 830. The candy 40 enters an inlet aperture 832 in the illustrative embodiment and engages in one of several retaining slots 860 formed in the wheel 850. The wheel 850 is connected to a wheel rotator 870 that is partially accessible to a user along the side of the page 830. Accordingly, a user can manipulate the wheel rotation 870 to rotate the internal wheel 850. When the retaining slot 860 of the wheel 850 containing the candy 40 is aligned with an exit passageway 835 leading to an outlet aperture 836, the candy 40 is released from the wheel 850 through the outlet aperture to the user.

Figure 9:
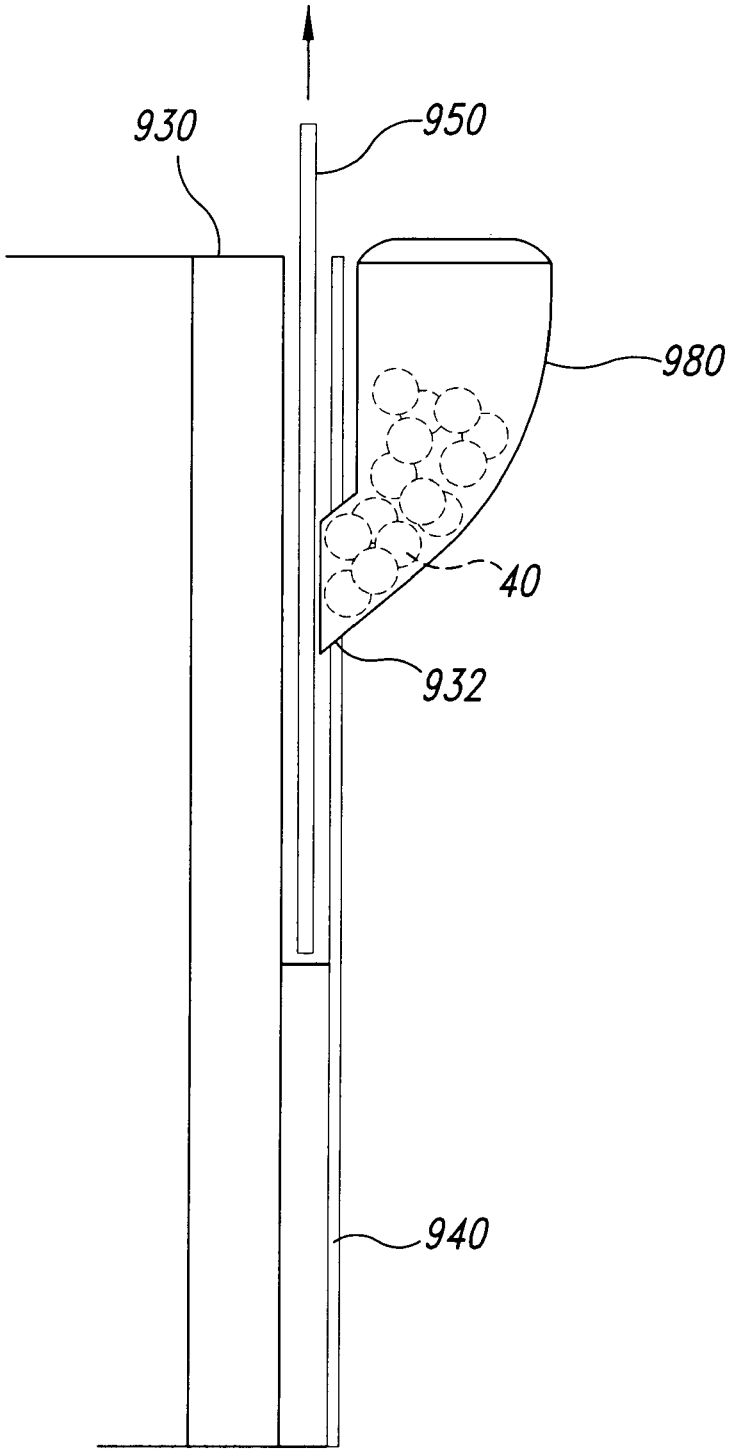
FIG. 9 is a side view of a book in accordance with another alternate embodiment, the book including a game piece dispenser.
Figure 10:
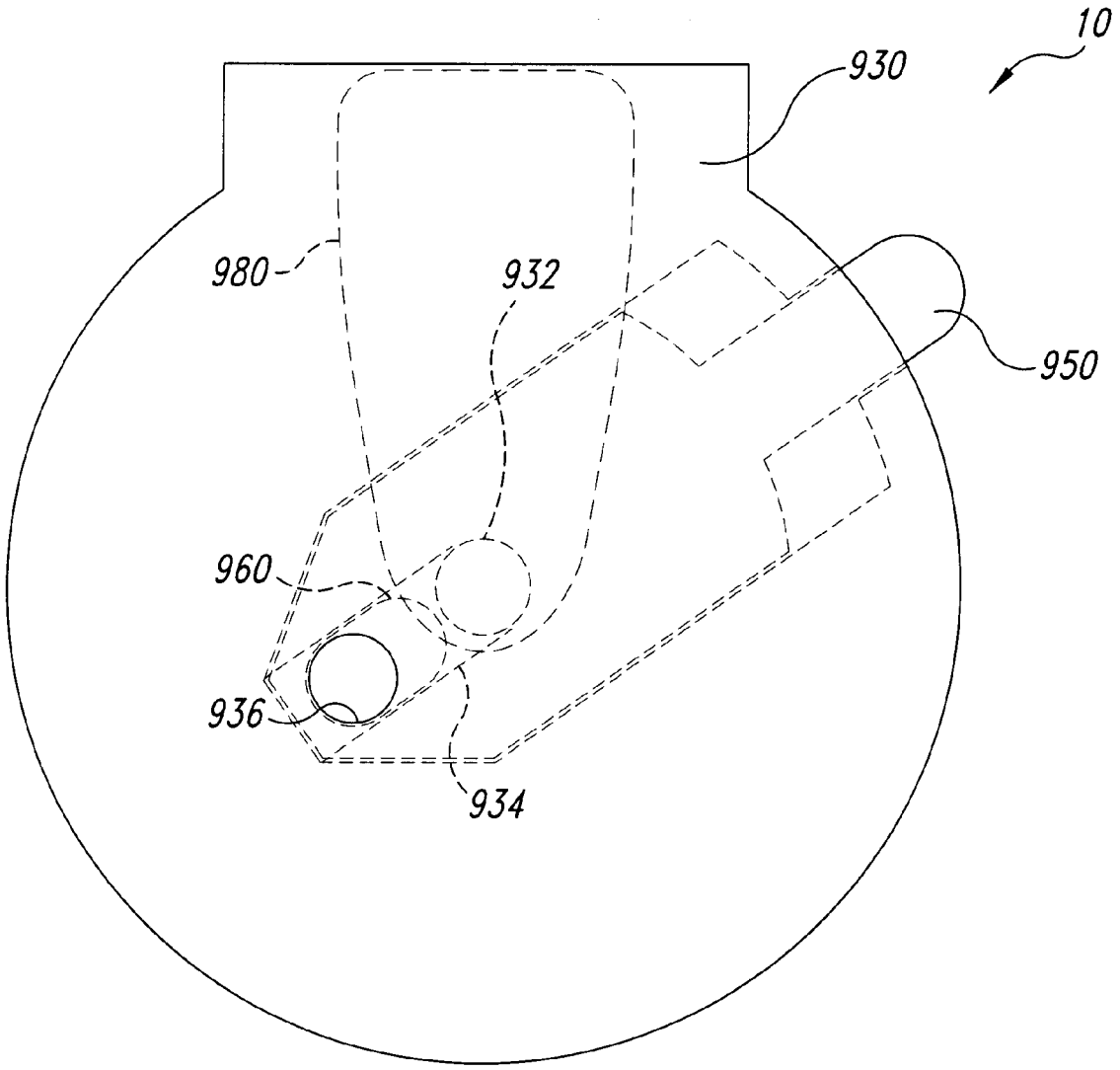
FIG. 10 is a front plan view of a page of the book of FIG. 12, the page includes an outlet aperture and the internal portion of the page includes a game piece actuator with a slot in communication with the passageway.

In another embodiment shown in FIGS. 9 and 10, the book includes an dispenser 980 that releasably contains the candy 40 or other selected game pieces. In the illustrated embodiment, the dispenser 980 is refillabe and is configured to dispense the candy 40 directly into an internal passageway 934 in a page 930 of the book. The dispenser 980 is mounted on a back cover 940 of the book 10. The dispenser 980 dispenses candy 40 through a supply dispensing aperture 932, directly into an internal passageway 934 (FIG. 10). As further shown in FIG. 10, a pullable tab 950 is slidably positioned adjacent to the supply dispensing aperture 932. The pullable tab 950 acts as an actuator that moves between a retaining position and a releasing position. In the retaining position, the pullable tab's retaining slot 960 is aligned with the supply dispensing aperture 932 in the game piece dispenser 980. In the releasing position, the slot 960 of the pullable tab 950 is substantially aligned with an outlet aperture 936 in the page 930 of the book 10. Moving the pullable tab 950 into the release position releases a piece of the candy supplied by the dispenser 980 by allowing the candy to travel through the passageway 934 and out through the outlet 936. The pullable tab 950 may be biased, such as by a spring or the like, to automatically return the actuator from the retaining position to the releasing position. In alternate embodiments, the integral game piece dispenser can form a portion of the binding or may be along an edge of the book 10.

The game piece dispenser provides easy and quick access to the candy 40 or other game pieces. Accordingly, the user can read and play through the book 10 repeatedly without having to search and find another piece of candy or game piece.

The various embodiments described above can be combined to provide further embodiments. Aspects of the invention can be modified, if necessary, to provide yet further embodiments of the invention.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A book useable with a game piece, comprising:

a plurality of interconnected pages, a first page having a first passageway therein sized to allow the game piece to move therethrough, the first passageway having a first inlet aperture shaped and sized to receive the game piece, and having a first outlet aperture spaced apart from and axially misaligned with the first inlet aperture and sized to allow the game piece to exit the first passageway, and a second page with a second passageway therein, the second page being adjacent to the first page, the second passageway being sized to allow the game piece to move therethrough, the second passageway having a second inlet aperture shaped and sized to receive the game piece, and having a second outlet aperture spaced apart from and axially misaligned with the second inlet aperture and sized to allow the game piece to exit the second passageway, wherein the first outlet aperture of the first page is aligned with the second inlet aperture of the second page when the first and second pages are adjacent to each other to allow the game piece to travel from the first passageway of the first page out the first outlet into the second inlet aperture of the second page.

2. The book of claim 1, wherein the first passageway has discontinuous first and second portions, and further including an actuator interconnecting the discontinuous first and second portions in the first page, the actuator being movable relative to the discontinuous first and second portions to allow the game piece to move between the discontinuous first and second portions of the first passageway.

3. The book of claim 1, further including an integral game piece dispenser with a dispensing aperture substantially aligned with the inlet aperture of the passageway.

4. The book of claim 3 wherein the game piece dispenser is refillable.

5. The book of claim 1, further including a plurality of game pieces coupled to the pages, each of the plurality of game pieces being configured to travel within the first passageway through the first page.

6. The book of claim 5 wherein the game pieces are edible.

7. The book of claim 1 wherein the pages are opaque and at least one of the first and first and second passageways within the respective one of the first and second pages is hidden from view.

8. A book useable with a game piece, comprising:

a plurality of interconnected pages, the pages having first and second outer layers, and a core layer therebetween, the core layer includes a channel defining an internal travel path within the page, the travel path extending between an inlet aperture and an outlet aperture, the outlet aperture being axially offset from the inlet aperture, the travel path, inlet aperture, and the outlet aperture being configured to allow a game piece to travel therethrough;

a game piece actuator, wherein the game piece actuator interconnects a discontinuous first and second portion of the travel path, the actuator being movable relative to the first and second portions to allow the game piece to move between the first and second portions of the travel path, wherein the actuator is positioned within the core layer of the page and is a slideable lever sandwiched between the first and second outer layers of the page, the lever being slideable between a first position substantially aligned with the first portion of the travel path and a second position substantially aligned with the second portion of the travel path, wherein the slideable lever further includes a slot to releasably retain a game piece therein.

9. The book of claim 8 wherein a game piece travel path within the page is blocked from view by the first outer layer.

10. The book of claim 8 further comprising a wheel in the core layer of the page, the wheel being rotatable between a first position substantially aligned with a first portion of the travel path and a second position substantially aligned with a second portion of the travel path, wherein the wheel further includes at least one slot to releasably retain a game piece therein.

11. The book of claim 8, further including a front cover and a back cover connected to the pages.

12. A book, comprising:

a plurality of interconnected pages, at least one page having a first outer layer, a second outer layer, and a core layer, the first and second outer layers sandwich the core layer, the core layer further includes channels to define an internal travel path extending between an inlet aperture and an outlet aperture; and an actuator in the core layer for moving between a first and second section of the travel path, wherein the actuator is a slideable lever, the slideable lever configured to reposition a game piece between the first and second sections of the travel path.

13. The book of claim 12 wherein the actuator is a rotatable wheel, the wheel having slots shaped and sized to retain a game piece.

14. The book of claim 12, further including a plurality of game pieces coupled to the book configured to move freely through the travel path of the page.

15. The book of claim 14 wherein the game pieces are edible.

16. A book useable with a game piece, comprising:

a plurality of interconnected pages, at least one page having a passageway therein sized to allow the game piece to move therethrough, the passageway having an inlet aperture shaped and sized to receive the game piece, and having an outlet aperture spaced apart from and axially misaligned with the inlet aperture and sized to allow the game piece to exit the passageway, wherein each of the plurality of interconnected pages have an internal passageway extending between an inlet aperture and an outlet aperture axially misaligned from each other, each passageway being sized to allow a game piece to pass therethrough from the inlet aperture to the outlet aperture, the outlet aperture of a first page being substantially aligned with the inlet aperture of an adjacent second page to allow a game piece to move from the outlet aperture of the first page through the inlet aperture of the adjacent second page into the internal passageway of the second page.

17. A book useable with a game piece, comprising:

a plurality of interconnected pages, the pages having first and second outer layers, and a core layer therebetween, the core layer includes a channel defining an internal travel path within the page, the travel path extending between an inlet aperture and an outlet aperture, the outlet aperture being axially offset from the inlet aperture, the travel path, inlet aperture, and the outlet aperture being configured to allow a game piece to travel therethrough; and a pullable tab in the core layer of the page, the tab being movable between a first position substantially aligned with a first portion of the travel path and a second position substantially aligned with a second portion of the travel path, wherein the tab further includes at least one slot for releasably retaining a game piece therein.

18. A book useable with a game piece, comprising:

a plurality of interconnected pages, the pages having first and second outer layers, and a core layer therebetween, the core layer includes a channel defining an internal travel path within the page, the travel path extending between an inlet aperture and an outlet aperture, the outlet aperture being axially offset from the inlet aperture, the travel path, inlet aperture, and the outlet aperture being configured to allow a game piece to travel therethrough, each travel path being sized to allow a game piece to pass therethrough from the inlet aperture through the outlet aperture, the outlet aperture of a first page being substantially aligned with the inlet aperture of an adjacent second page such that a game piece can move between the outlet aperture of the first page through the inlet aperture of the adjacent second page into the internal travel path of the second page.

19. A book, comprising:

a plurality of interconnected pages, at least one page having a first outer layer, a second outer layer, and a core layer, the first and second outer layers sandwich the core layer, the core layer further includes channels to define an internal travel path extending between an inlet aperture and an outlet aperture; and an actuator in the core layer for moving between a first and second section of the travel path, the actuator is a pullable tab, wherein movement of the tab from a first retaining position in which a slot of the tab is substantially aligned with the first section of the travel path, to a second releasing position in which the slot of the tab is substantially aligned with the second section of the travel path, is capable of transporting a game piece between the first and second sections of the travel path.

20. A book useable with a game piece, comprising:

a plurality of interconnected pages, at least one page having a first outer layer, a second outer layer, and a core layer, the first and second outer layers sandwich the core layer, the core layer further includes channels to define an internal travel path extending between an inlet aperture and an outlet aperture;

each travel path being sized to allow the game piece to pass therethrough from the inlet aperture to the outlet aperture, and the outlet aperture of a first page positioned adjacent to the inlet aperture of an adjacent second page, wherein the game piece travels from the outlet aperture of the first page to the inlet aperture of the adjacent second page; and an actuator in the core layer for moving between a first and second section of the travel path.

* * * * *

UNITED STATES PATENT AND TRADEMARK OFFICE

CERTIFICATE OF CORRECTION

PATENT NO. : 6,210,248 B1
DATED : April 3, 2001
INVENTOR(S) : Christine McAdam

It is certified that error appears in the above-identified patent and that said Letters Patent is hereby corrected as shown below:

Title page,
Item [57], line 6 of the Abstract, replace "form" with -- from --.

Column 8,
Line 18, prior to "first and second", delete "first and".

Signed and Sealed this

Second Day of October, 2001

*Attest:*

Nicholas P. Godici

*Attesting Officer*

NICHOLAS P. GODICI
*Acting Director of the United States Patent and Trademark Office*